US005111012A

United States Patent [19]

Hyun et al.

[11] Patent Number: 5,111,012

[45] Date of Patent: May 5, 1992

[54] ELECTRONIC MICROWAVE HEATING APPARATUS

[75] Inventors: Whoang J. Hyun; Mun H. Jo, both of Kyungki, Rep. of Korea

[73] Assignee: SamSung Electronics Co., Ltd., Suwon, Rep. of Korea

[21] Appl. No.: 523,521

[22] Filed: May 15, 1990

[30] Foreign Application Priority Data

May 16, 1989 [KR] Rep. of Korea ..... 89-6342[U]
Nov. 14, 1989 [KR] Rep. of Korea ..... 89-16768[U]

[51] Int. Cl.[5] ..... H05B 6/80

[52] U.S. Cl. ..... 219/10.55 R; 219/10.55 F; 219/400; 126/21 A

[58] Field of Search ..... 219/10.55 R, 10.55 B, 219/10.55 E, 10.55 F, 400; 126/21 R, 21 A

[56] References Cited

U.S. PATENT DOCUMENTS 3,083,528 4/1963 Brown ..... 219/10.55 R
3,854,219 12/1974 Staats ..... 219/10.55 R
4,100,463 7/1978 Sugie ..... 219/10.55 R
4,337,384 6/1982 Tanaka et al. ..... 219/10.55 B
4,477,706 10/1984 Mittelsteadt ..... 219/10.55 B
4,481,396 11/1984 Matsubayashi et al. ..... 219/10.55 B
4,803,324 2/1989 Fujii et al. ..... 219/10.55 F
4,940,869 7/1990 Scholtes et al. ..... 219/10.55 F

*Primary Examiner*—Philip H. Leung
*Attorney, Agent, or Firm*—Robert E. Bushnell

[57] ABSTRACT

An electronic wave heating apparatus is adapted to use the microwave generated by a magnetron, in which the microwave generated by the magnetron and introduced through a waveguide into the heat exchanging chamber while being dispersed to be uniformly irradiated into the heating exchanging chamber, and then the air introduced into the heat exchanging chamber via the blowing device is heat exchanged with being directly impinged against the microwaves or with being contacted with the absorbant mounted in the heat exchanging chamber, so that the heated air is discharged to heat a room, thereby accomplishing a good heating state, good air conditioning state and smoke pollution free state.

12 Claims, 4 Drawing Sheets

ELECTRONIC MICROWAVE HEATING APPARATUS

BACKGROUND OF THE INVENTION

The invention is related to providing an electronic wave heating apparatus using the ultrahigh frequency of the electronic wave (referred to the microwave below) generated by a magnetron, and particularly to providing a structure of an electronic wave heating apparatus for preventing the leakage of the microwave.

It has been known that a heating apparatus using the microwave frequency of the magnetron has not been attempted in the prior art until now.

The heating apparatus is generally referred as to a heating apparatus for heating a room in order of the heating of the indoor air and the convection of the heated air. The type of a heating apparatus is at most classified by a heat source. In other words, current heating apparatus use the heat energy generated according to the combustion of fuel or the application of a power source to the electric coil or the nichrome wire.

Even though a relatively superior heating apparatus for the firing of fuel, for example gas or petroleum, is used to heat a room, the fact is that complete combustion has not yet been realized in spite of their research and development. Thus when the fuel is burnt, it has a problem that a heating apparatus causes smoke pollution having the incomplete combustion gas. In order to reduce the smoke pollution, a heating apparatus tends to be complex and is made relatively large, following that it is not economical in light of its manufacturing cost.

Further, a conventional heating apparatus could not avoid generation of soot or poisonous gas harmful to the human body, if it is used for a long period. It has had the inconvenience and problems that the indoor air must be exchanged with the fresh air to prevent a loss of life during its use in the closed space.

Also, a conventional heating apparatus using the power source is provided with an electric coil, such as nichrome wire, which is in the form of a concentric circle, and a thermal reflecting plate mounted around or near its periphery, so that when the power source is applied the heat energy generated from the electric coil is reflected by means of the thermal reflecting plate to heat the air. But it has happened often that a fire accident has been caused by overheating of the electric wire or a safety accident by a short circuit.

Also, such like heating apparatus could not meet the user's expectation with respect to the heating effect and the heating time taken since their initial heating is weak and/or their uniform indoor heating takes relatively longer.

In light of these points, it is very innovative that the heating effect is maximized as well as ideal indoor heating is realized without smoke pollution caused by incomplete combustion gas, or the problems of the fire and safety accidents.

On the other hand, it is well known that a microwave oven using the microwave generated from the magnetron performs a cooking operation with a dielectric heating plate or a absorbing plate which absorbs the energy generated by the microwave and emits heat. Therefore, assuming that a microwave oven is used as a heating apparatus without the leakage of microwaves, it is noted that the disadvantages of the conventional heating apparatus can be easily overcome.

That is to say, a conventional typical microwave oven is described in Japan Patent Publication No. Sho. 51-10689. Japan Patent Publication No. Sho. 51-10689 discloses that the microwave energy generated by the magnetron is introduced into the lower portion of the heating room through the waveguide, and the microwave absorbant for absorbing the microwave energy is mounted on the lower portion of the heating room to emit heat, thereby cooking the foods placed on the lower portion.

With it, a microwave oven can be adapted to a heating apparatus on the ground of the fact that it must be provided with means for blowing the heat-exchanged air into the indoor, means for introducing/discharging the air, and means for preventing the leakage of microwaves.

SUMMARY OF THE INVENTION

Accordingly, the main object of the invention is to provide an electronic wave heating apparatus having a good heating state, good air conditioning state and good safety with the magnetron having high heat efficiency.

Another object of the invention is to provide the structure of an electronic wave heating apparatus for preventing the leakage of microwaves.

Thus, the first embodiment of the invention includes a case made in the form of a rectangular body or a cylindrical body, the inner portion of which is divided into a heat exchanging chamber formed on its upper portion, an electric mechanic chamber formed on the lower portion and an auxiliary chamber formed on the rear side of said heat exchanging chamber and said electric mechanic chamber; a high voltage transformer and means for generating microwaves which are electrically connected to each other and mounted properly in said electric mechanic chamber; means for guiding the microwave, into which the antenna of said microwave generating means is received while mounted in said auxiliary chamber; means mounted at the rear of said guiding means in said auxiliary chamber to forcedly blow the microwave and the air from the outside; means for transferring its motive power by means of a pulley to said blowing means and cooling the inner portion of said electric mechanic chamber; means for absorbing the microwave and heating by itself, which is made as a plurality of a curved surfaces integrally connected to each other in order to widen the contacting surface with the microwave and which is mounted in the predetermined position; and means mounted at the front of said heat exchanging chamber to discharge the heat exchanged air from said heat exchanging chamber.

Also, the second embodiment of the invention is constructed to more effectively prevent the outward leakage of the microwave compared with the prevention of microwave leakage in the first embodiment. The second embodiment includes a case made in the form of the rectangular body, the inner portion of which is divided into a heat exchanging chamber formed on its upper portion, an electric mechanic chamber formed on its lower portion and an auxiliary chamber formed on the rear side of said heat exchanging chamber and said electric mechanic chamber; a high voltage transformer and means for generating the microwave which are electrically connected to each other and mounted properly in said electric mechanic chamber; means mounted at the rear wall of said guiding means in said auxiliary chamber to forcedly blow the microwave and the air from the outside; means for intaking the air blown forcedly from said auxiliary chamber into said heat exchanging chamber, which is formed on the rear wall of said heat exchanging chamber; a transmitting plate mounted on the center portion of said rear wall to introduce the microwave from said waveguide into said heat exchanging chamber; means mounted rotatably at the center of the transmitting plate to disperse the microwave introduced through the transmitting plate; a plurality of heat absorbing members mounted at predetermined positions in said heat exchanging chamber, which is curved to widen the contact surface with the microwave and to absorb microwave energy to heat by itself; means mounted on the front surface of said heat exchanging chamber for blocking the outward leakage of the microwave, which is an absorbant having numerous holes for discharging the heat-exchanged air; and means mounted adjacent to said microwave blocking means to discharge the heat exchanged air.

Therefore, the invention generates the microwave at the magnetron, and the microwave is introduced through the waveguide into the heat exchanging chamber while being dispersed to be uniformly irradiated into the heating exchanging chamber. At this time, the air introduced into the heat exchanging chamber by means of the blowing means is heat-exchanged by being directly impinged against the microwave or by being contacted with the absorbant mounted in the heat exchanging chamber, so that the heated air is discharged out of the outside to heat a room.

As a result, it is known that the invention may be considered as an innovative invention which can enhance the heat efficiency due to using the magnetron, can prevent the leakage of electronic waves harmful to the human body and can maintain a good air conditioning state in the indoor.

BRIEF DESCRIPTION OF THE DRAWINGS

The invention will be described below in detail with reference to the accompanying drawings.

DETAILED DESCRIPTION OF THE INVENTION

Figure 1:
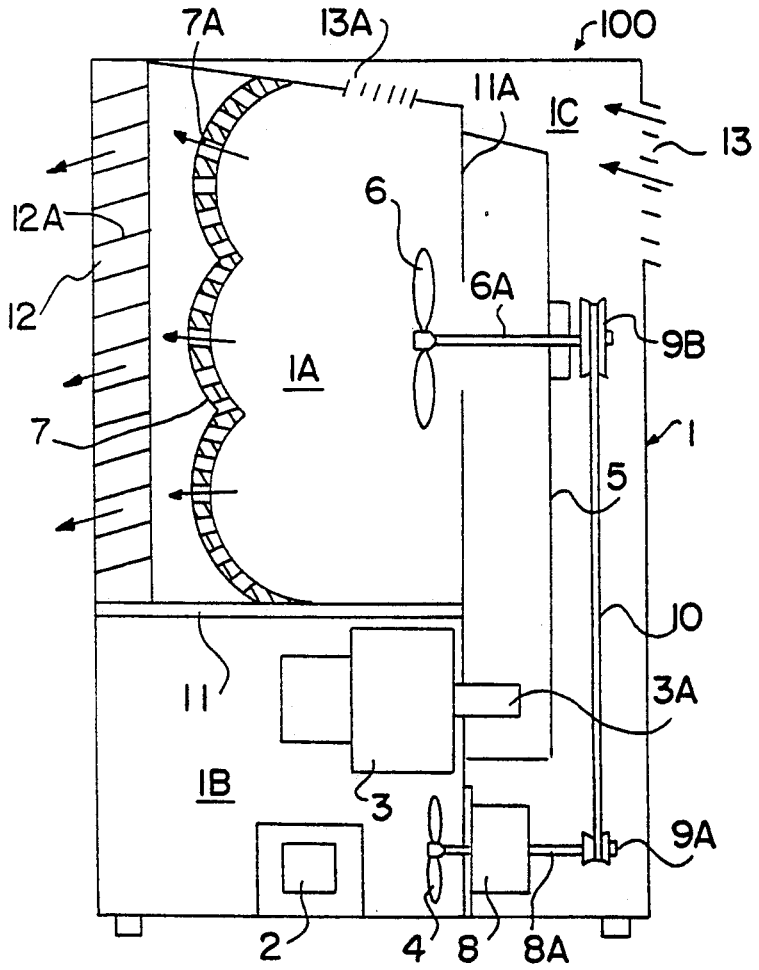
FIG. 1 is a cross-sectional view showing the first embodiment of an electronic wave heating apparatus according to the principle of the invention.
Figure 2A:
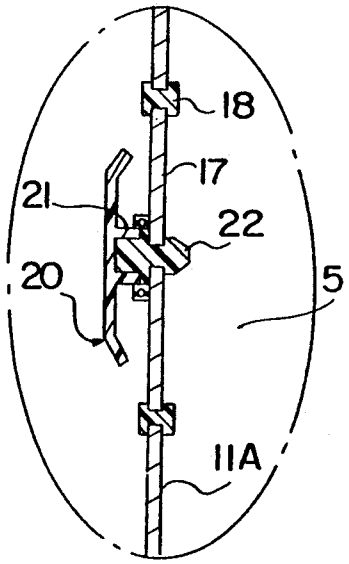
FIG. 2A is a enlarged cross-sectional view showing the microwave transmitting plate and the dispersing fan mounted between the microwave guiding means and the heat exchanging chamber according to the principle of the invention.
Figure 2:
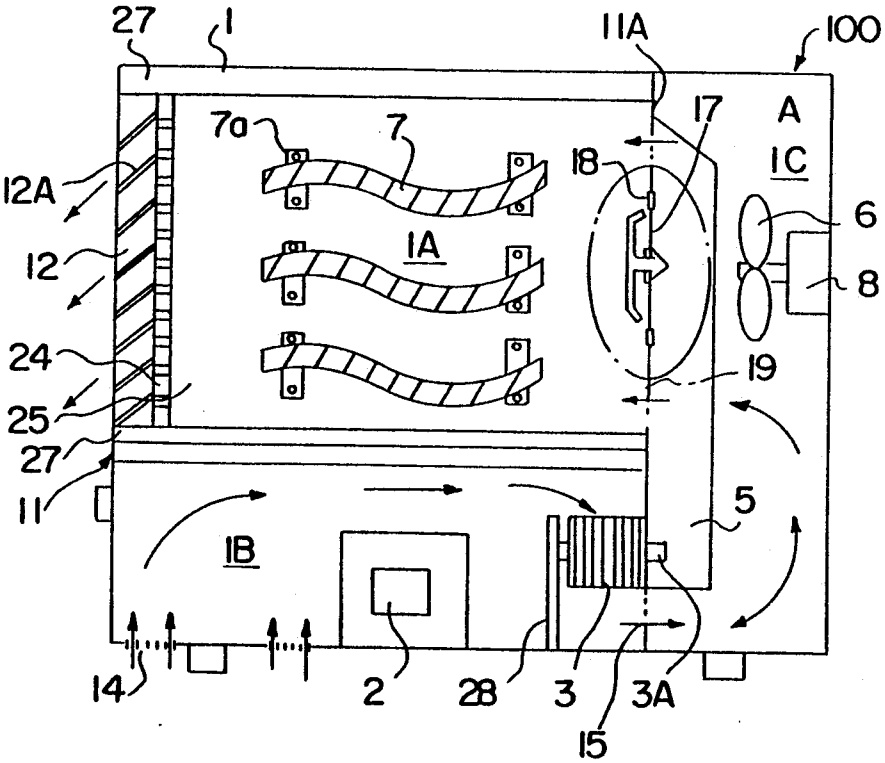
FIG. 2 is a cross-sectional view showing the second embodiment of an electronic wave heating apparatus according to the principle of the invention.
Figure 3:
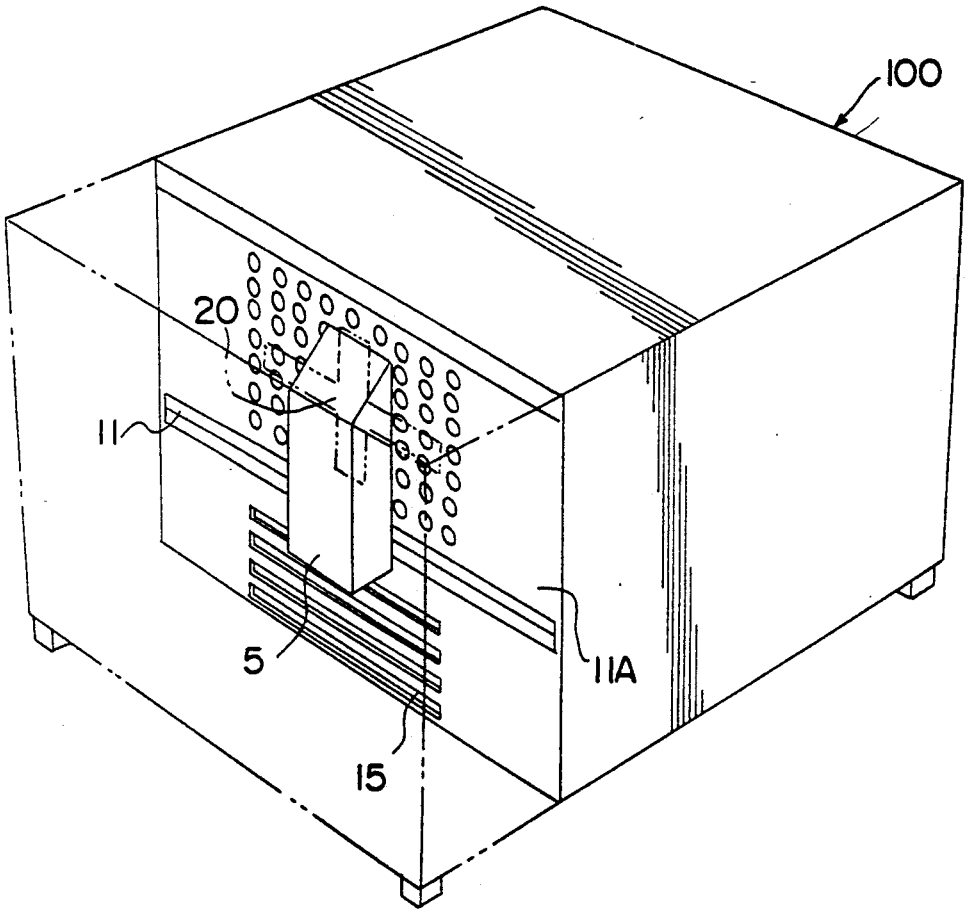
FIG. 3 is a perspective view showing the rear side of the second embodiment of an electronic wave apparatus according to the principle of the invention; and, FIG. 4 is a perspective view showing the configuration of the microwave absorbing member which may be used in the second embodiment of the invention.

Referring to FIG. 1, heating apparatus 100 according to the invention comprises case 1 which may be made as a rectangular form or cylindrical form. Case 1 is divided into three portions including heat exchanging chamber 1A, electric mechanic chamber 1B and auxiliary chamber 1C. That is, partition wall 11 is transversely fixed at the predetermined position near the middle portion of case 1 and partition wall 11A is longitudinally installed near the rear wall of case 1, so that the upper portion and the lower portion are respectively formed as heat exchanging chamber 1A and electric mechanic chamber 1B by partition wall 11, and auxiliary chamber 11C is formed by partition wall 11A.

Electric mechanic chamber 1B is provided with high voltage transformer 2 and magnetron 3 properly installed therein. High voltage transformer 2 and magnetron 3 are electrically connected to each other. Cooling fan 4 connected to driving motor 8 is mounted near the lower of partition wall 11A to cool the heat generated by transformer 2 and magnetron 3.

Auxiliary chamber 1C is provided with waveguide 5 for guiding the microwave and driving motor 8 mounted therein. Waveguide 5 is provided with antenna 3A of magnetron 5 projected from partition wall 11A. Driving motor 8 is fixed to the lower portion of partition wall 11A to rotate cooling fan 4 and has shaft 8A extended backward therefrom, and on the end of which pulley 9A is mounted. Pulley 9A is connected by means of belt 10 for transferring the driving force of motor 8 to blowing fan 6 described below to pulley 9B which is fixed to the rear end of the rotating shaft 6A extended backward from blowing fan 6 supported on the rear surface of waveguide 5, so that both of pulleys 9A, 9B are simultaneously operated. Intaking portion 13 is formed on the upper of the rear wall of case 1 to intake the air from the outside into case 1.

Heat exchanging chamber 1A is provided with the hollow portion formed therein, discharging portion 12 formed on its front surface and blowing fan 6 mounted on its rear surface to disperse the microwave as well as to discharge the air introduced from air intaking hole 13A, which is formed on the upper wall of heat exchanging chamber 1A. Also at the middle portion of heat exchanging chamber 1A there is longitudinally mounted heating member 7 having a wave shaped section to separate the inner portion of heat exchanging chamber 1A into the left side and the right side, in which heating member 7 acts to absorb the microwave supplied from waveguide 5 and heat by itself.

Heating member 7 includes numerous pieces connected to each other, which provide a surface curved with a predetermined curvature to widen the surface contacting the microwave, preferably. The curved surface of heating member 7 is provided with numerous ventilating holes 7A pierced at an equivalent space staggered against the air blowing direction so as to absorb/block the microwave, in which ventilating holes 7A have an inner diameter formed at the appropriated rate according to the impedance relationship of the microwave to prevent the leakage of the microwave.

With it, the microwave supplied from waveguide 5 is completely absorbed at heating member 7. The air introduced by blowing fan 6 into heat exchanging chamber 1A is heat exchanged by the calorification of heating member 7. The heat exchanged air is forcedly discharged into the indoor through discharging portion 12 to obtain a warming effect on the indoors.

Also, numerous blowing air guide members 12A are mounted on the front surface of discharging portion 12 and are slanted downward at a regular gap, so that the heat exchanged air is downwardly blown into the indoor to promote convection, thereby increasing the heating efficiency.

As described above, it is noted that first embodiment of the invention successfully accomplishes the enhancement of heating efficiency, air conditioning state and heating state that it has not been realized until now.

A second embodiment of the invention is almost same as the basic configuration of first embodiment except for the structure for blocking the leakage of the microwave, and will be described below with the reference number attached to the parts being the same as the parts of the first embodiment.

As described in first embodiment, heating apparatus 100 according to second embodiment of the invention includes a case 1 which may be made with rectangular form or the cylindrical form. Case 1 is divided into three portions including heat exchanging chamber 1A, electric mechanic chamber 1B and auxiliary chamber 1C. That is, partition wall 11 is transversely fixed at the predetermined position near the middle portion of case 1 and partition wall 11A is longitudinally installed near the rear wall of case 1, so that the upper portion and the lower portion are respectively formed as heat exchanging chamber 1A and electric mechanic chamber 1B by partition wall 11, and auxiliary chamber 11C formed by partition wall 11A.

Electric mechanic chamber 1B is provided with high voltage transformer 2 and magnetron 3 properly installed therein, in which high voltage transformer 2 and magnetron 3 are electrically connected to each other, and magnetron 3 is mounted by supporting member 13 to project its antenna 3A from waveguide 5 to guide the microwave, in which waveguide 5 is installed in auxiliary chamber 1C as described below. Air intaking portion 14 is formed on the lower portion of electric mechanic chamber 1B, and numerous air intaking holes 15 are formed around the lower of partition wall 11A.

Auxiliary chamber 1C is provided with waveguide 5 mounted near partition wall 11A to introduce the microwave into heat exchanging chamber 1A and the fan assembly including fan 6 and motor 8, which are supported on the rear wall of case 1, so that the operation of motor 8 makes the air introduction from the outside through air intaking portion 14 into auxiliary chamber 1C so that it cools high voltage transformer 2 and magnetron 3.

Heat exchanging chamber 1A is constructed so that heating member or absorbing member 7 (called as the absorbing member 7 for convenience's sake) mounted therein absorbs the microwave and effectively heats the air introduced from the outside by its calorification. That is, waveguide 5 for guiding the microwave is mounted on the rear surface of partition wall 11A of heat exchanging chamber 1A, and transmitting member 17 for passing the microwave therethrough is attached at a predetermined site by means of fixing means 18 to the middle portion of partition wall 11A over partition wall 11. Around the periphery of transmitting member 17, there are formed numerous air circulating apertures 19 for introducing the air from auxiliary chamber 1C throughout the predetermined area. At the center of transmitting member 17, there is fixed dispersing fan 20 which is rotated by the blowing energy of the microwave from magnetron 3 and the blowing force of the fan motor assembly to disperse the microwave. Dispersing fan 20 is made in the form of the cross and fixed by means of fixer 21 and bolt 22, etc. to be freely rotated, so that it acts to forcedly blow the air introduced from auxiliary chamber 1C and disperse the microwave.

Figure 4:
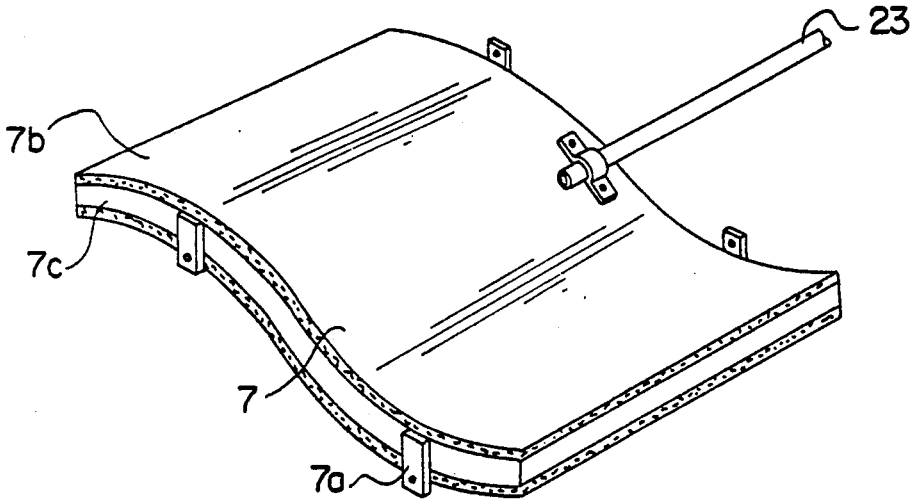

Absorbing member 7 is preferably made in the form of the wave to have a relatively wider area contacting with the microwave dispersed by dispersing fan 20 as shown in FIG. 4, near each of the corners of which fixing pieces **7*a* are attached, so that absorbing member 7 can be mounted in heat exchanging chamber 1A. Also, absorbing member 7 may be provided with absorbent 7*b* covered on its body 7*c* and heating body merged between both of absorbent 7*b* except for an integral body functioning simultaneously as the absorbent and the heating body as described in first embodiment. Also absorbing member 7 may have temperature detector 23 for the operational control of all its system. Therefore a number of absorbing members 7 are horizontally installed by means of screws cooperating with fixing piece 7*a* in the hollow portion of heat exchanging chamber 1A. Discharging portion 12 is made on the front surface of heat exchanging chamber 1A to discharge the air heat exchanged with absorbing member 7 into the indoor. A plurality of blowing air guide members 12A are mounted on the front surface of discharging portion 12 and slanted downwardly at a regular gap, so that the heat exchanged air is downwardly blown into the indoor to promote the convection, thereby increasing the heating efficiency. Blocking member 24 is mounted adjacent to the rear side of discharging portion 12 to block the microwave into the indoor. This blocking member 24 is provided with numerous ventilating holes 12A pierced at an equivalent space staggered against the air blowing direction so as to absorb/block the microwave, in which ventilating holes 12A** have their inner diameter formed at the appropriated rate according to the impedance relationship of the microwave to prevent the leakage of the microwave.

Accordingly, it is known that second embodiment of the invention is to provide an electronic wave heating apparatus 100. That is, the microwave generated at magnetron 3 is supplied through waveguide 5 into heat exchanging chamber 1A and dispersed by the fan motor assembly including fan 6 and motor 8 and dispersing fan 20, while its energy is absorbed by absorbing member 7, and absorbing member 7 begins its calorification. Then, the air introduced by the fan motor assembly into heat exchanging chamber 1A is heat-exchanged and then discharged through discharging portion 12 from out of the inside.

Herein, it is noted that dispersing fan 20 is rotated by the microwave and the air blown from the outside to uniformly disperse the microwave irradiated into heat exchanging chamber 1A through waveguide 5, so that the microwave is randomly impinged against the rear and front surface of absorbing member 7 or the air to heat the air, directly or indirectly with the good thermal efficiency as well as the rotating force of fan 6 and dispersing fan 20 forcedly emitting the heat exhanged air out of heat exchanged chamber 1C. At this time, since absorbing member 7 is horizontally mounted in the hollow portion of heat exchanging chamber 1A, the emitting of the heated air is smoothly performed. Also, since blocking member 24 is mounted near the rear surface of discharging portion, the microwave, which is not absorbed by absorbing member 7, is blocked so that it is not emitted into the indoor altogether with the heated air, thereby preventing the leakage of the microwave harmful to the human body.

On the other hand, insulative member 27 is attached on the inner upper and lower wall of heat exchanging chamber 1A to prevent the transferring of the high temperature to case 1 and electric mechanic chamber 1A. Since absorbing member 7 is provided with temperature detector 23 mounted on its surface, the overheating of absorbing member 7 is previously prevented to operate all its system under good condition when the air from the air circulating passage including the air intaking portion and the circulating holes, etc. is not introduced into heat exhanging chamber 1A and the heat exchanging is not performed.

Accordingly, an electronic wave heating apparatus 100 of the invention uses the microwave of the magnetron cooperating with absorbing member 7 which is mounted in heat exchanging chamber 1A. It is known that the invention has various advantages with respect to the good heating state accomplished by enhancing the air heat exchanging efficiency, the prevention of microwave leakage out of the inside into the indoor and getting rid of the smoke pollution caused by firing of the fuel, such as the petroleum, etc..

What is claimed is:

1. An electronic wave heating apparatus, comprising:

a case provided with an inner portion divided into a heat exchanging chamber, an electric and mechanical chamber and an auxiliary chamber;

high voltage means and means for generating microwaves, electrically connected to each other and mounted in said electric and mechanical chamber;

means for guiding the microwaves, mounted in said auxiliary chamber, into which an antenna of said microwave generating means is received;

means mounted at the rear of said guiding means in said auxiliary chamber, for forcedly drawing air from outside said case to cool the inner portion of said electric and mechanical chamber;

means for absorbing the microwaves and performing calorification, said absorbing means including a plurality of curved surfaces integrally connected to each other in order to widen the contacting surface with microwaves, said absorbing means being at a predetermined position; and means mounted at the front of said heat exchanging chamber for discharging heat exchanged air from said heat exchanging chamber.

2. An electronic wave heating apparatus as claimed in claim 1, further comprised of said absorbing means including numerous pieces connected to each other and curved with a predetermined curvature to have a relatively wider contacting surface with the microwaves.

3. An electronic wave heating apparatus as claimed in claim 1, further comprised of said absorbing means being provided with numerous ventilating holes pierced at an equivalent space to be at an oblique angle from the air blowing direction so as to absorb the microwaves, said ventilating holes having inner diameters formed at a rate according to an impedance relationship of the microwaves to prevent leakage of the microwaves.

4. An electronic wave heating apparatus, comprising:

a case divided into three portions, including a heat exchanging chamber formed on a first of said portions, an electromechanical chamber formed on second of said portions and an auxiliary chamber formed on a rear side of said heat exchanging chamber and electric mechanic chamber;

high voltage means and means for generating the microwave electrically connected to each other and mounted in said electric mechanic chamber;

means mounted at the rear of said microwave guiding mean in said auxiliary chamber to forcedly blow microwaves and air from outside said case;

means for intaking air blown forcedly from said auxiliary chamber into said heat exchanging chamber, said intaking means being formed on a rear wall of said heat exchanging chamber;

a transmitting member mounted on a center portion of said rear wall to introduce microwaves from said waveguide into said heat exchanging chamber;

means mounted rotatably at the center of said transmitting member to disperse microwaves introduced through said heat exchanging chamber;

at least one absorbing member mounted at a predetermined position in said heat exchanging chamber, each said absorbing member being curved to widen the contact surface with the microwaves and absorb microwave energy and emit heat;

means mounted on a front surface of said heat exchanging chamber, for blocking leakage of the microwaves outwardly, said blocking means being made of an absorbent perforated by numerous holes for discharging heat exchanged air; and means mounted adjacent to said blocking means to discharge the heat exchanged air.

5. An electronic wave heating apparatus as claimed in claim 4, further comprised of said absorbing member having a form of a wave to provide a relatively wider area contacting microwaves dispersed by said dispersing means and horizontally mounted in said heat exchanging chamber.

6. An electronic wave heating apparatus as claimed in claim 4, further comprised of said absorbing member being provided with an absorbent covering its body, and a heating body merged between both of said absorbent and a temperature detecting means for operation control of said apparatus.

7. An electric wave heating apparatus as claimed in claim 4, further comprised of said blocking means being provided with numerous ventilating holes pierced at an equivalent space staggered against the air blowing direction so as to absorb the microwaves, said ventilating holes having inner diameters formed at a rate according to an impedance relationship of the microwaves to prevent leakage of the microwaves.

8. An electronic wave heating apparatus as claimed in claim 4, further comprised of said heat exchanging chamber including an insulative member mounted therein.

9. An electronic heater, comprising:

a case having an interior divided into a first chamber, a second chamber and a third chamber;

microwave generating means disposed in said first chamber, for generating microwaves;

waveguide means for conducting said microwaves from said first chamber through said second chamber and to said third chamber;

first vent means for enabling passage of air from said second chamber and into said third chamber;

second vent means for enabling passage of air from inside said third chamber to outside of said case;

means for causing air to pass into said third chamber via said first vent means; and means positioned with said third chamber and surrounded by air within said third chamber, for absorbing said microwaves entering said third chamber from said waveguide means.

10. The electronic heater of claim 9, further comprised of said absorbing means having a plurality of curved surfaces integrally connected to each other.

11. The electronic heater of claim 9, further comprised of said absorbing means extending across said third chamber, being formed of a material for absorbing said microwaves and being perforated by a plurality of apertures enabling passage of air from said first vent means, through said third chamber, and through said second vent means.

12. The electronic heater of claim 9, further comprised of:

said absorbing means being formed by a plurality of discrete elements spaced apart within said third chamber, with each of said elements having a major exterior surface bearing a material for absorbing said microwaves; and said second vent means including a layer of a substance for absorbing said microwaves perforated by a plurality of apertures permitting passage of air from within said third chamber to outside said case via said second vent means, with said layer being coextensive with said second vent means.

* * * * *

UNITED STATES PATENT AND TRADEMARK OFFICE

CERTIFICATE OF CORRECTION

PATENT NO. : 5,111,012
DATED : 5 May 1992
INVENTOR(S) : Whoang–Jin HYUN, et al.

It is certified that error appears in the above-indentified patent and that said Letters Patent is hereby corrected as shown below:

Column 1,

Line 13, before "heating", delete " a ",

IN THE CLAIMS

Column 8,

Line 31, before "operation", insert --the--,

Line 59, after "positioned", , change "with" to --within--:

Signed and Sealed this

Twenty-fifth Day of June, 1996

*Attest:*

BRUCE LEHMAN

*Attesting Officer*

*Commissioner of Patents and Trademarks*